US005387077A

United States Patent [19]

Yatsuka et al.

[11] Patent Number: 5,387,077

[45] Date of Patent: Feb. 7, 1995

[54] APPARATUS FOR HANDLING SIGNATURES

[75] Inventors: Kou Yatsuka, Amagasaki; Shigenori Tashima, Osaka, both of Japan

[73] Assignee: Gunze Limited, Ayabe, Japan

[21] Appl. No.: 980,793

[22] PCT Filed: May 6, 1992

[86] PCT No.: PCT/JP92/00592

§ 371 Date: Mar. 3, 1993

§ 102(e) Date: Mar. 3, 1993

[87] PCT Pub. No.: WO93/01060

PCT Pub. Date: Jan. 21, 1993

[30] Foreign Application Priority Data

Jul. 4, 1991 [JP] Japan ..... 3-51798[U]
Jul. 4, 1991 [JP] Japan ..... 3-164700

[51] Int. Cl.[6] ..... B65G 57/08

[52] U.S. Cl. ..... 414/791; 414/790.4; 414/791.1; 414/907; 414/792.2

[58] Field of Search ..... 414/789.8, 790.2, 790.4, 414/790.8, 791, 792.3, 792.4, 792.2, 795.7, 907, 788.6

[56] References Cited

U.S. PATENT DOCUMENTS

| | | | |
|---|---|---|---|
| 3,450,275 | 6/1969 | Carlen, Jr. | 414/792.2 |
| 4,197,045 | 4/1980 | Stauber | 414/907 |
| 4,296,684 | 10/1981 | Wangermann | 414/907 |
| 4,432,685 | 2/1984 | Stauber . | |
| 4,514,128 | 4/1985 | Hedrick | 414/790.8 |
| 4,547,112 | 10/1985 | Steinhart | 414/907 |
| 4,657,465 | 4/1987 | Aoki | 414/907 |
| 4,725,180 | 2/1988 | Kasamotsu et al. . | |

FOREIGN PATENT DOCUMENTS

| | | | |
|---|---|---|---|
| 0181987 | 5/1986 | European Pat. Off. | 414/907 |
| 57-62153 | 4/1982 | Japan . | |
| 189964 | 11/1982 | Japan | 414/792.4 |
| 58-82818 | 5/1983 | Japan . | |
| 60-15352 | 1/1985 | Japan . | |
| 62-193924 | 8/1987 | Japan . | |
| 63-171765 | 7/1988 | Japan . | |
| 158559 | 6/1990 | Japan | 414/907 |

*Primary Examiner*—Michael S. Huppert
*Assistant Examiner*—Gregory A. Morse
*Attorney, Agent, or Firm*—Oblon, Spivak, McClelland, Maier, & Neustadt

[57] ABSTRACT

The signature handling apparatus of the invention includes a first stacker for accumulating layers of signatures, a second stacker for piling a plurality of small stacks of the signatures accumulated by the first stacker, and a pair of third stackers arranged below the first stacker and below the second stacker respectively, the pair of third stackers being reciprocatingly revolvable. The signatures on the first stacker are transferred to one of the third stackers, and signatures which have been stacked on the other of the third stackers are transferred to the second stacker.

5 Claims, 11 Drawing Sheets

APPARATUS FOR HANDLING SIGNATURES

TECHNICAL FIELD

The present invention relates to an apparatus for handling signatures transported from a printing press or the like so as to pile the signatures into small stacks and pile such small stacks of signatures into a large stack.

BACKGROUND ART

For example, Unexamined Japanese Patent Publication SHO 63-171765 for the specification of U.S. Pat. No. 4,725,180 already discloses a handling apparatus of this type. This conventional apparatus has a receiving unit for piling on a receiving plate a required number of signatures (sheets of printed paper, folded sheets of paper) delivered from a printing unit, and a stacking unit disposed below the receiving unit and movable upward and downward. An upward feed plate, which is movable upward and downward, is provided laterally adjacent to the stacking unit. A collecting unit is further disposed above this feed plate.

A small stack of signatures as piled on the receiving plate is transferred onto the stacking unit disposed therebelow. The small stack of signatures on the stacking unit is delivered onto the upward feed plate by a pusher plate and then into the collecting unit upon rising the feed plate. Such small stacks are piled in layers into a large stack within the unit.

However, the conventional apparatus has drawbacks. The apparatus requires much time for downwardly delivering the small stack of signatures from the receiving plate to the stacking unit, pushing the stack onto the upward feed plate and further transport. Stacks of signatures are liable to collapse during transport, and the lowermost of the stacked signatures is susceptible to damage.

Further because the uppermost signature of the small stack is in a free state during the transfer from the receiving plate to the stacking unit, the signature is likely to slip out of place and to be further stacked in this state. When small stacks are piled into a large stack in the collecting unit, the folds of signatures of small stacks become bulky, permitting slippage of signatures or causing jamming during transport. Consequently, signatures will be stacked up with some remaining out of register with the others so as to become soiled, damaged or bent and to result in an impaired quality, and hence problems.

An object of the present invention, which has been accomplished in view of the foregoing situation, is to provide a signature handling apparatus which is adapted to efficiently transport signatures as stacked up from a receiving portion to a stacker and further to another stacker without collapsing and free of damage.

DISCLOSURE OF THE INVENTION

To fulfill the above object, the present invention provides the following technical means.

More specifically, the present invention provides a signature handling apparatus which is characterized in that the apparatus comprises:

a first stacker for stacking signatures transported by a conveyor in layers, a second stacker for piling a plurality of small stacks of signatures stacked by the first stacker, and a pair of third stackers arranged below the first stacker and below the second stacker respectively, the pair of third stackers being reciprocatingly revolvable, the signatures on the first stacker being transferable to one of the third stackers, signatures as stacked on the other third stacker being transferable to the second stacker.

Preferably, the first stacker has a receiving plate horizontally movable for opening or closing a bottom side thereof.

Preferably, the pair of third stackers are each mounted on a support member projecting from each of diametrically opposite sides of a revolving shaft rotatable about a vertical axis.

Preferably, the pair of third stackers are each fixed to a rotary member mounted on the support member and rotatable about a vertical axis.

Preferably, the rotary member is provided with a cylinder movable upward and downward and having a lift member, and the third stacker has a cutout aperture for the lift member to pass therethrough.

Preferably, the third stacker is provided with pressing pieces upwardly movable with the lift member while pressing a small stack of signatures from above.

Preferably, each of the pressing pieces is attached to a stretchable cylinder rotatably mounted on the third stacker.

Preferably, the first stacker is provided with a signature pressing member for lowering the small stack of signatures onto one of the third stackers positioned immediately below the first stacker while pressing the stack from above.

According to the present invention, signatures delivered as divided into groups of required number of signatures from a printing press or the like are piled into a small stack on the first stacker. The small stack is transferred to the third stacker as positioned therebelow, whereupon the third stacker is revolved to a position below the second stacker. The stack is then transferred from the third stacker to the second stacker.

Stated more specifically, signatures are transferred from the first stacker to the third stacker in the following manner.

When signatures are piled in the first stacker, the lift member of the third stacker rises, and the receiving plate of the first stacker moves to open the bottom of the same stacker, whereby the signatures in the first stacker are allowed to fall onto the lift member. The signatures are then placed on the third stacker by the descent of the lift member. The signatures in the form of a small stack is pressed by the pressing pieces during the descent. Subsequently, the third stackers are revolved about a vertical axis through 180 degrees; the third stacker carrying the signatures is positioned immediately below the second stacker, and the other third stacker, which is empty, is positioned immediately below the first stacker. The lift member below the second stacker then rises. The signatures on the lift member are released from the pressing pieces simultaneously with or during raising of the left member, and piled in the second stacker to form a large stack. The unloaded lift member descends to a stand-by position. On the other hand, the lift member of the third stacker positioned immediately below the first stacker rises to receive another small stack of signatures from the first stacker, followed by the above operation repeatedly.

When the small stack of signatures is delivered from the first stacker to the third stacker with the uppermost signature layer portion pressed by the signature pressing member provided for the first stacker, the signatures can be delivered neatly without slipping out of place or change misregistered.

The pressing pieces provided on the third stacker hold the small stack of signatures in shape by pressing the bulky folds of the signatures, thus preventing the sheets from slipping out of place and ensuring a smooth and neat stacking operation free of damage.

With the apparatus of the invention having the foregoing construction, the signatures delivered from the first stacker can be efficiently held under pressure and piled into stacks which remain in shape and free of damage during pressing and transport. Furthermore, stacking of signatures from the first stacker can be effected concurrently with stacking of signatures in the second stacker. This results improved efficiency of the apparatus and both renders the apparatus easy to operate and make it compact in size.

When the first stacker is provided with the signature pressing member for lowering the small stack of signatures onto one of the third stackers which is positioned immediately therebelow while pressing the stack from above, the small stack can be efficiently delivered from the first stacker to the third stacker without permitting slippage of signatures or misregistered or folded sheets, and can be further stacked without folding and be free of damage.

Further when the third stacker is provided with the pressing pieces which are upwardly movable with the lift member while pressing the small stack of signatures from above, the stack can be transported and moved upwardly from the third stacker to the second stacker without permitting some signatures to slip out of place, be moved out of register with the others or become damaged, and without the likelihood that some signatures will be kicked out by support pieces. This prevents impairment of quality, eliminates the necessity of adjusting the opening or closing timing of the support pieces and makes the apparatus very easy to operate.

BEST MODE OF CARRYING OUT THE INVENTION

Figure 1:
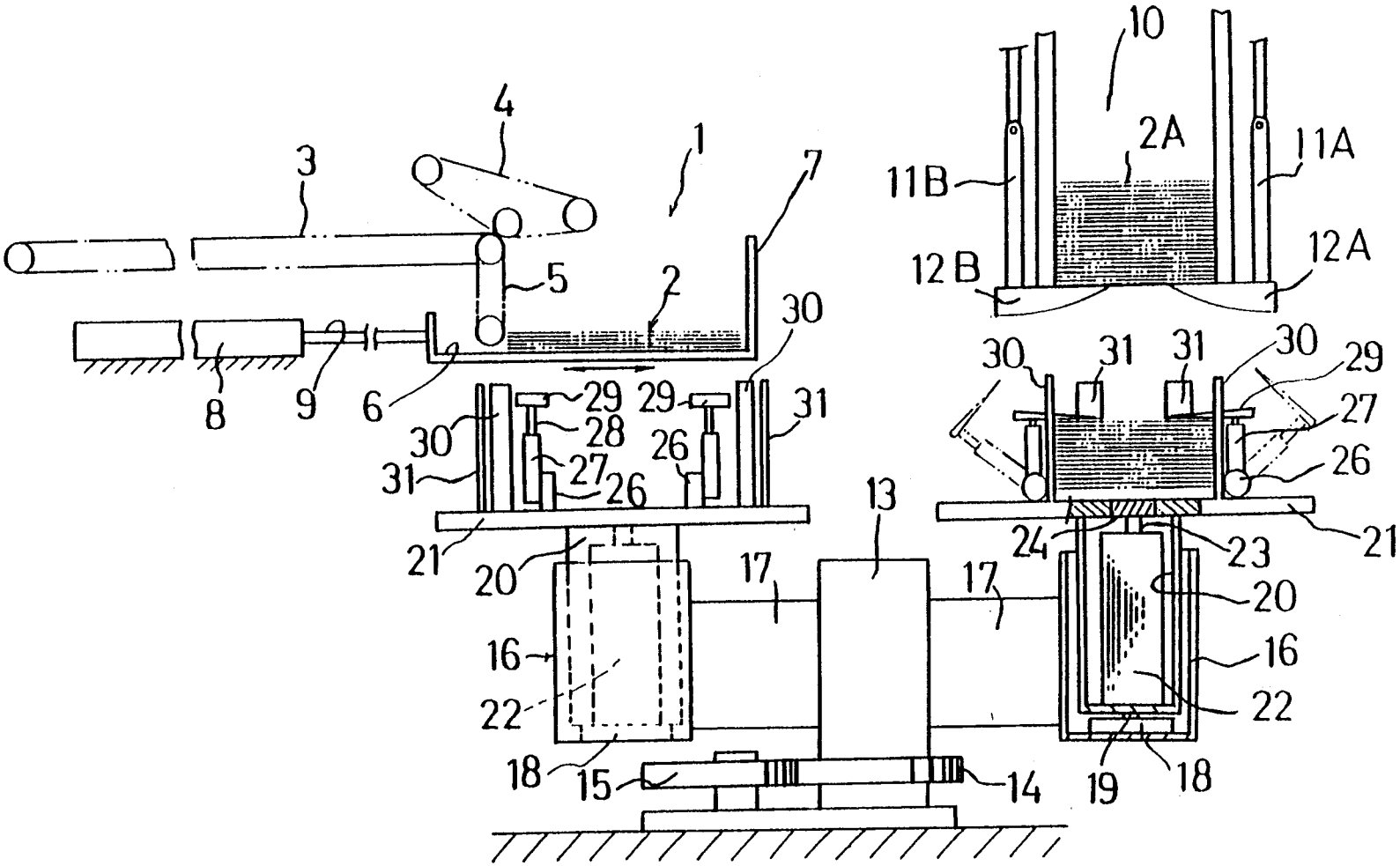
FIG. 1 is a sectional side elevation schematically showing a first embodiment of the invention.
Figure 2:
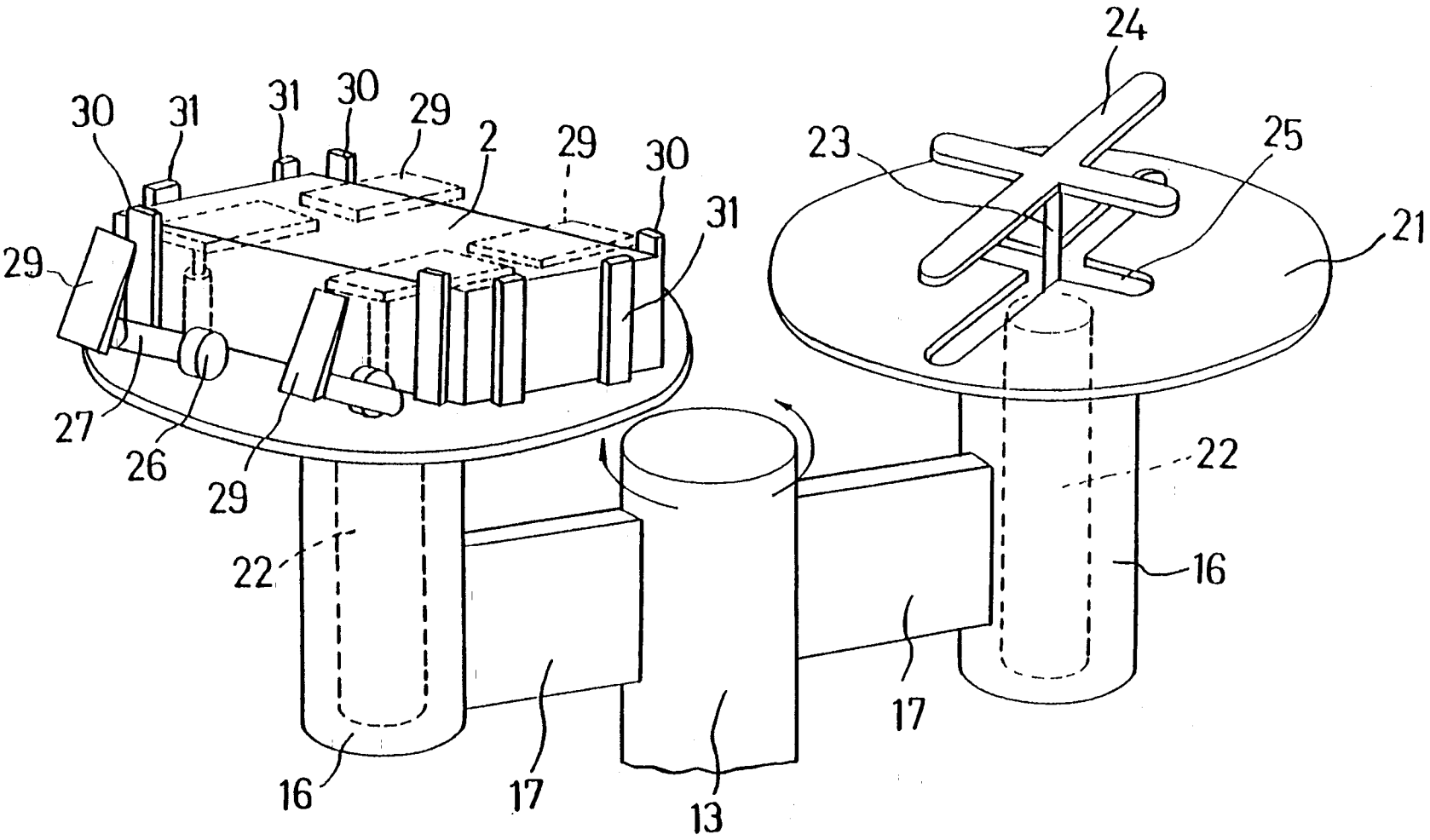
FIG. 2 is a perspective view for illustrating the operation of a stacker with some of the guide and pressing pieces omitted.

Embodiments of the present invention will be described below with reference to the drawings, FIGS. 1 to 9 show a first embodiment of the invention. Indicated at 1 is a first stacker for accumulating a stack of signatures 2. A required number of signatures 2 transported from a printing press (not shown) by a conveyor 3, holding belt 4 and feed belt 5 are piled into a small stack on a receiving plate 6 by the first stacker 1.

The first stacker 1 has a side plate 7 positioned in corresponding relation with the widthwise dimension of signatures 2 with respect to the direction of advance thereof. An air cylinder 8 has a piston 9 fixed to the receiving plate 6. The air cylinder 8 horizontally moves the receiving plate 6, thereby opening or closing the bottom of the first stacker 1.

Indicated at 10 is a second stacker, which is positioned laterally away from the first stacker 1. A plurality of small stacks of signatures 2 accumulated by the first stacker 1 are piled into a large stack 2A by the second stacker 10. The second stacker 10 has a pair of rods 11A, 11B pivotally movably supported, and support pieces 12A, 12B secured to the lower ends of the rods 11A, 11B, respectively. The large stack 2A of signatures is supported on the support pieces 12A, 12B. The rods 11A, 11B, when pivotally moved, move the support pieces 12A, 12B to open or close the bottom of the second stacker 10.

A revolving shaft 13 rotatable about a vertical axis is disposed between the first and second stackers 1, 10 therebelow. A gear 14 is fixed to the shaft 13 at a lower portion thereof and is in mesh with a drive gear 15. The revolving shaft 13 is reciprocatingly rotatable by the drive gear 15. A pair of support members 16, 16 are fixed to the revolving shaft 13 by a pair of opposite connectors 17, 17.

A rotating air cylinder 18 is provided inside of each of the support members 16, 16. The cylinder 18 has a rod 19 with a rotary member 20 fixedly connected thereto. A third stacker 21 for signatures 2 is secured to the upper end of the rotary member 20.

An air cylinder 22 is provided within each of the rotary members 20. The cylinder 22 has a piston 23, to which a lift member 24 is fixed. The third stacker 21 has a base with a cutout aperture 25 formed therein through, which the lift member 24 can pass.

Rotating air cylinders 26 are mounted on the third stacker 21. Each cylinder 26 has a drive rod (not shown), to which an air cylinder 27 is fixed. A pressing pieces 29 is secured to the outer end of piston rod 28 of the cylinder 27. The third stacker 21 slidably has guide pieces 30, 31 at right, left, front and rear positions. The guide pieces 30, 31 surround a space serving as a stacking portion for signatures 2.

One of the pair of third stackers 21, 21 is positioned below the first stacker 1, and the other below the second stacker 10. The pair of third stackers 21, 21 are replaceable with each other by the rotation of the revolving shaft 13.

The third stackers 21, 21, which may be separate, may alternatively comprise, for example, a circular, elliptical or rectangular stacking plate which is reciprocatingly rotatable so as to provide a pair of stackers which are integral. Furthermore, more than two stackers may be provided which are revolvable in one direction.

The operation of the first embodiment will be described below.

First, signatures 2 (single sheets of paper, signatures folded in two, etc.) are sent forward by known means such as the conveyor 3 as seen in FIG. 1 and successively allowed to fall onto the receiving plate 6 for stacking. In the meantime, the lift member 24 is raised from the position of the third stacker 21 by the operation of the piston 23 of the air cylinder 22 and remains in a stand-by position below the rear side of the receiving plate 6.

Next, when a required number of signatures 2 for one stack is piled on the receiving plate 6, the cylinder 8 retracts the plate 6, opening the bottom of the first stacker 1, whereby the signatures in the form of a small stack on the receiving plate 6 are allowed to fall onto the lift member 24 positioned therebelow and are placed on the member. The lift member 24 subsequently descends to the original position, and the stack of signatures 2 is placed on the third stacker by being guided by guides pieces 30, 31. At the same time, the rotating air cylinders 26 and the air cylinders 27 operate, turning and lowering the pressing pieces 29 toward the signatures 2 to press the small stack from above.

On the other hand, the receiving plate 6 is advanced again by the cylinder 8 to close the bottom of the first stacker 1. Signatures 2 for the second stack sent forward as divided in groups as stated above are similarly allowed to fall onto the receiving plate 6 successively and piled.

Figure 3:
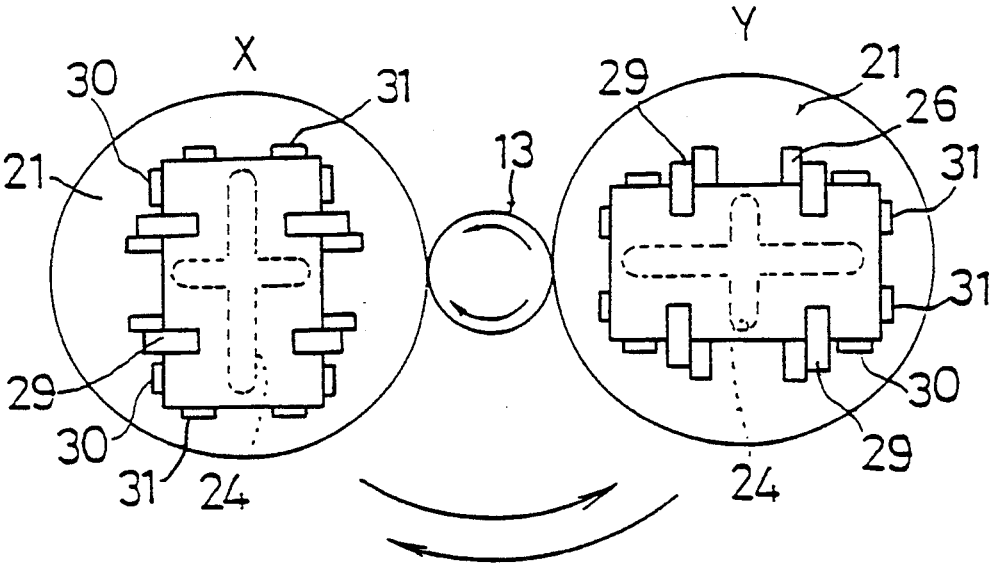
FIG. 3 is a plan view for illustrating the operation of stackers and lift members.
Figure 4:
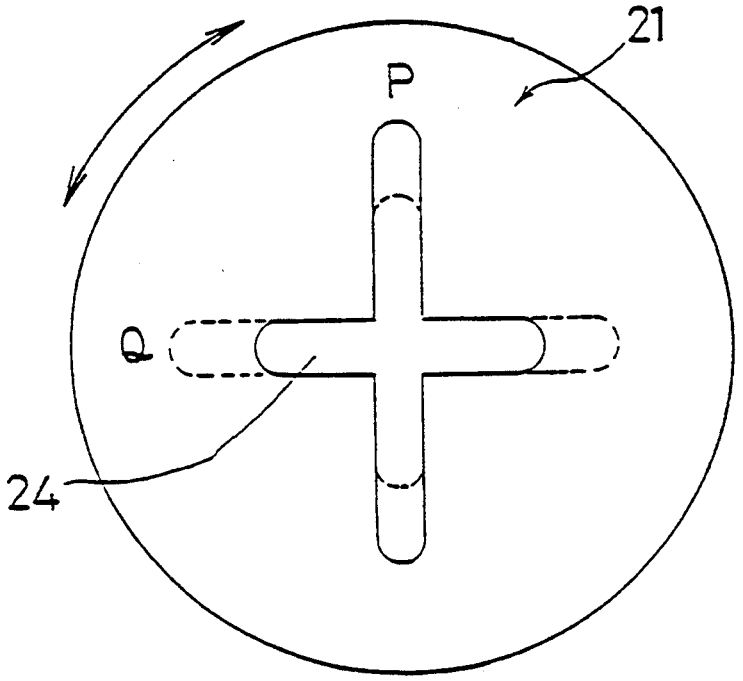
FIG. 4 is a plan view for illustrating the operation of the stacker and the lift member.

After the signatures 2 for the first stack have been piled on the third stacker 21 as described above, the revolving shaft 13 is rotated through about 180 degrees by the drive gear 15 and gear 14, whereby the third stacker 21 is moved from a position X below the first stacker 1 to a position Y as seen in FIG. 3. The rotating cylinder 18 then operates to rotate the third stacker 21 through about 90 degrees. This rotates the lift member 24 from a vertically elongated position P to a horizontally elongated position Q as shown in FIG. 4. The signatures 2 of the first stack in a vertically elongated state in the position X are thus rotated to a horizontally elongated state in the position Y as seen in FIG. 3.

The signatures are then relieved of the pressure by the pressing pieces 29, and the air cylinder 22 thereafter operates to raise the lift member 24, whereby the signatures 2 of the second stack thereon are piled into the second stacker 10. Next, the lift member 24 descends to the original position, and is further rotated from the position Q to the original position P by the operation of the rotating air cylinder 18 as shown in FIG. 4.

When the third stacker 21 carrying the signatures 2 of the first stack reaches the position Y from the position X as stated above, the empty third stacker 21 revolves from the position Y to the position X with the lift member 24 in the vertically elongated position P as shown in FIG. 4 and made ready for receiving the signatures of the second stack in a vertically elongated state. Subsequently in the same manner as above, the piston 23 of the air cylinder 22 operates, raising the lift member 24 from the position of the third stacker 21 to its stand-by position below the rear side of the receiving plate 6.

When the required number of signatures 2 for the second stack have been subsequently piled on the receiving plate 6, the receiving plate 6 retracts, allowing the signatures 2 of the second stack to fall onto the lift member 24 positioned below the plate and to be placed thereon. The lift member 24 then descends to its original position (position of the third stacker 21). The same operation as above thereafter follows to form a large stack of signatures 2A within the second stacker 10. The large stack of signatures 2A thus piled up is thereafter transported to the next process, i.e., a binding unit for binding.

Figure 5:
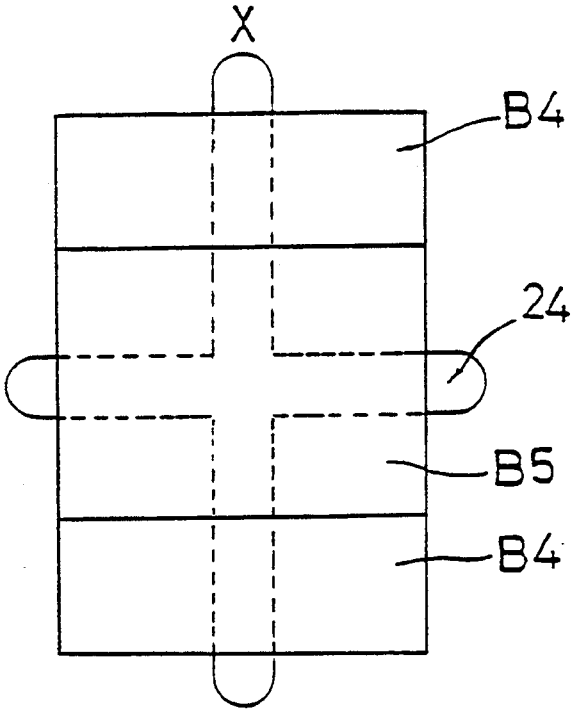
FIG. 5 is a plan view showing the position of signatures and the lift member relative to each other.

When signatures 2 are transported by the conveyor 3, for example, when signatures 2 of B4 size or B5 size (single sheets of paper, signatures as folded in two, or the like) are transported, the signatures of B4 size are usually positioned in a vertically elongated state, or those of B5 size are positioned in a horizontally elongated state. Accordingly, signatures B4 of B4 size and signatures B5 of B5 size are stacked on the lift member 24 in the position X below the first stacker 1, as positioned in the vertically elongated state and in the horizontally elongated state, respectively, as seen in FIG. 5.

Figure 6:
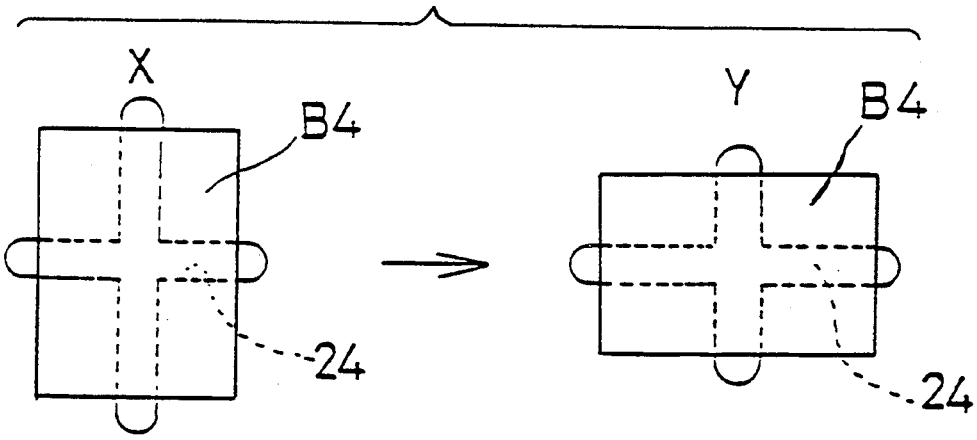
FIG. 6 is an operation illustrating plan view showing a change in the position of the lift member by rotation.

In the case of the signatures B4 shown in FIG. 6, therefore, the third stacker 21 itself rotates (leftward or rightward) through about 90 degrees about its own axis when revolving from the position X below the first stacker 1 to the position Y below the second stacker 10. More specifically, the lift member 24 rotates from the position P to the position Q as shown in FIG. 4, whereby the signatures B4 are brought, as rotated to the horizontally elongated state, to the position Y below the second stacker 10, and are piled in this state.

Figure 7:
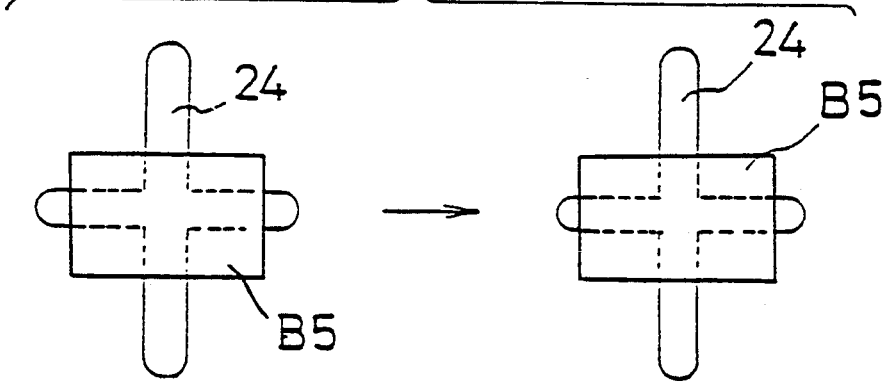
FIG. 7 is an operation illustrating plan view showing the position of the lift member remaining unchanged in position.

Further in the case of the signatures B5 shown in FIG. 7, the third stacker 21 itself does not rotate about its own axis in any way when revolving from the position X below the first stacker 1 to the position Y below the second stacker 10. Thus, the lift member 24 remains out of rotation with the signatures B5 remaining in the same horizontally elongated state as in the position X, and the signatures are piled in this state.

Figure 8:
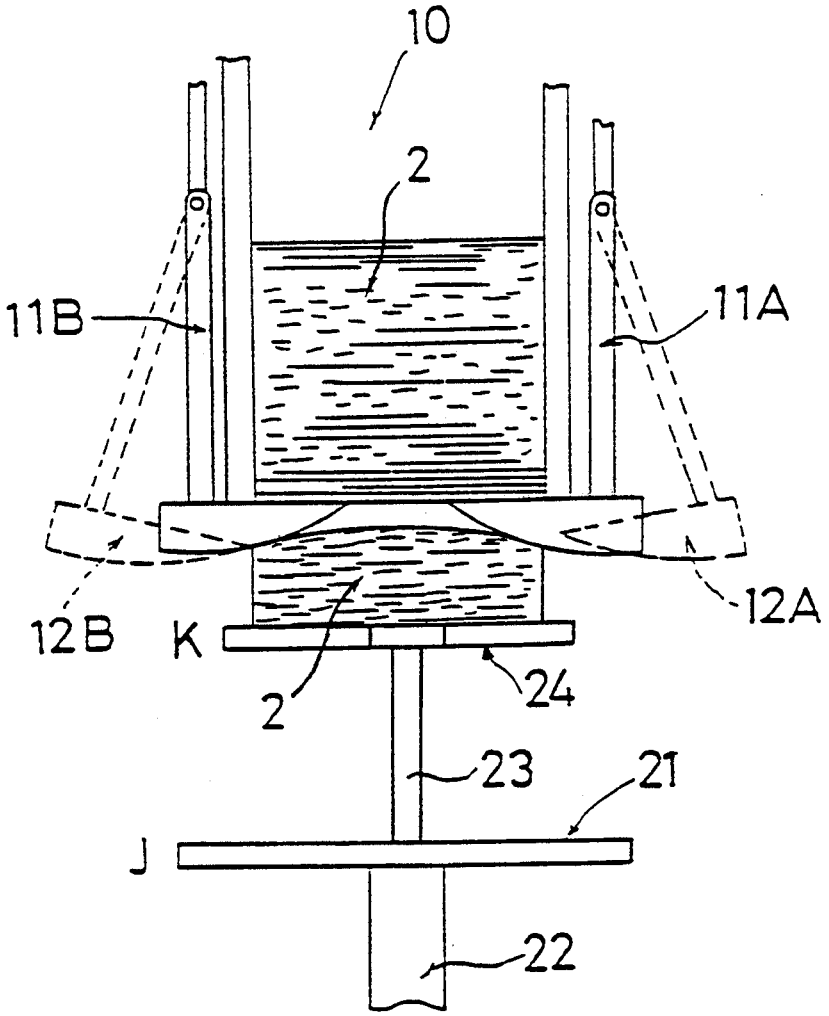
FIG. 8 is an operation illustrating side elevation showing signatures as stacked.

The large stack of signatures 2A may be formed in the following manner. When the lift member 24 is raised from the position J of the third stacker 21 by the operation of the air cylinder 22, the uppermost of the stacked signatures 2 comes into contact with the rear side of the support pieces 12A, 12B in the closed position as seen in FIG. 8. In this position, the operation of the air cylinder 22 is temporarily interrupted to press the opposite side portions of the stack of signatures 2 against the respective support pieces 12A, 12B and thereby remove air from the signatures 2. The support pieces 12A, 12B are thereafter retracted to their opened state, and the air cylinder 22 is operated again to raise the lift member 24 for stacking. The removal of air from the signatures 2 thus effected prevents the stack from collapsing, ensuring an effective stacking operation.

Figure 9:
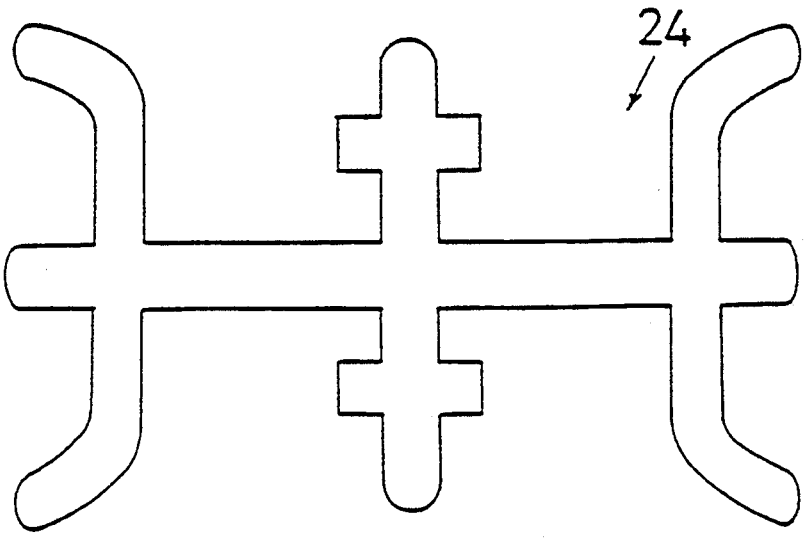
FIG. 9 is a plan view showing a lift member of a different form.
Figure 10:
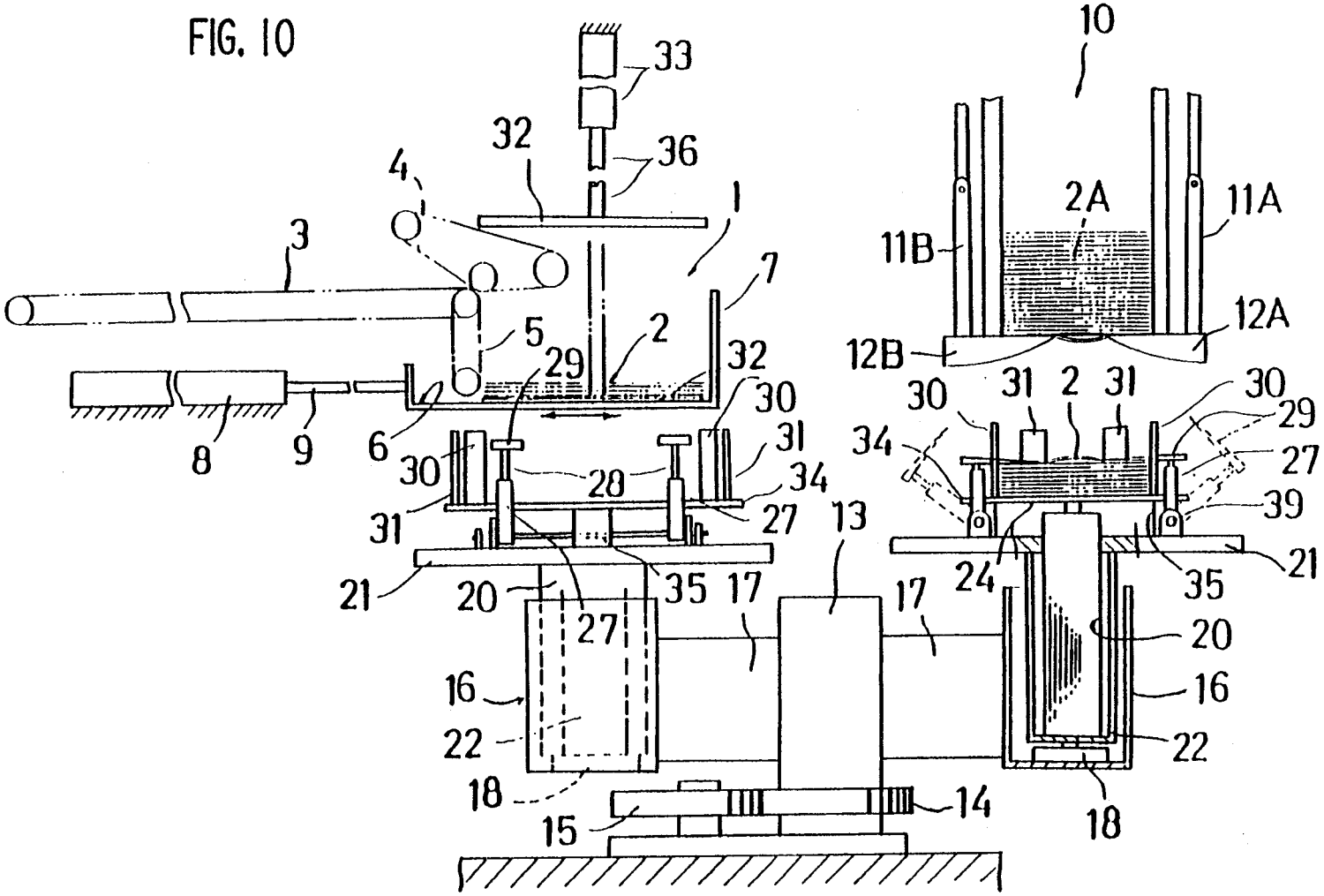
FIG. 10 is a sectional side elevation schematically showing a second embodiment of the invention.
Figure 11:
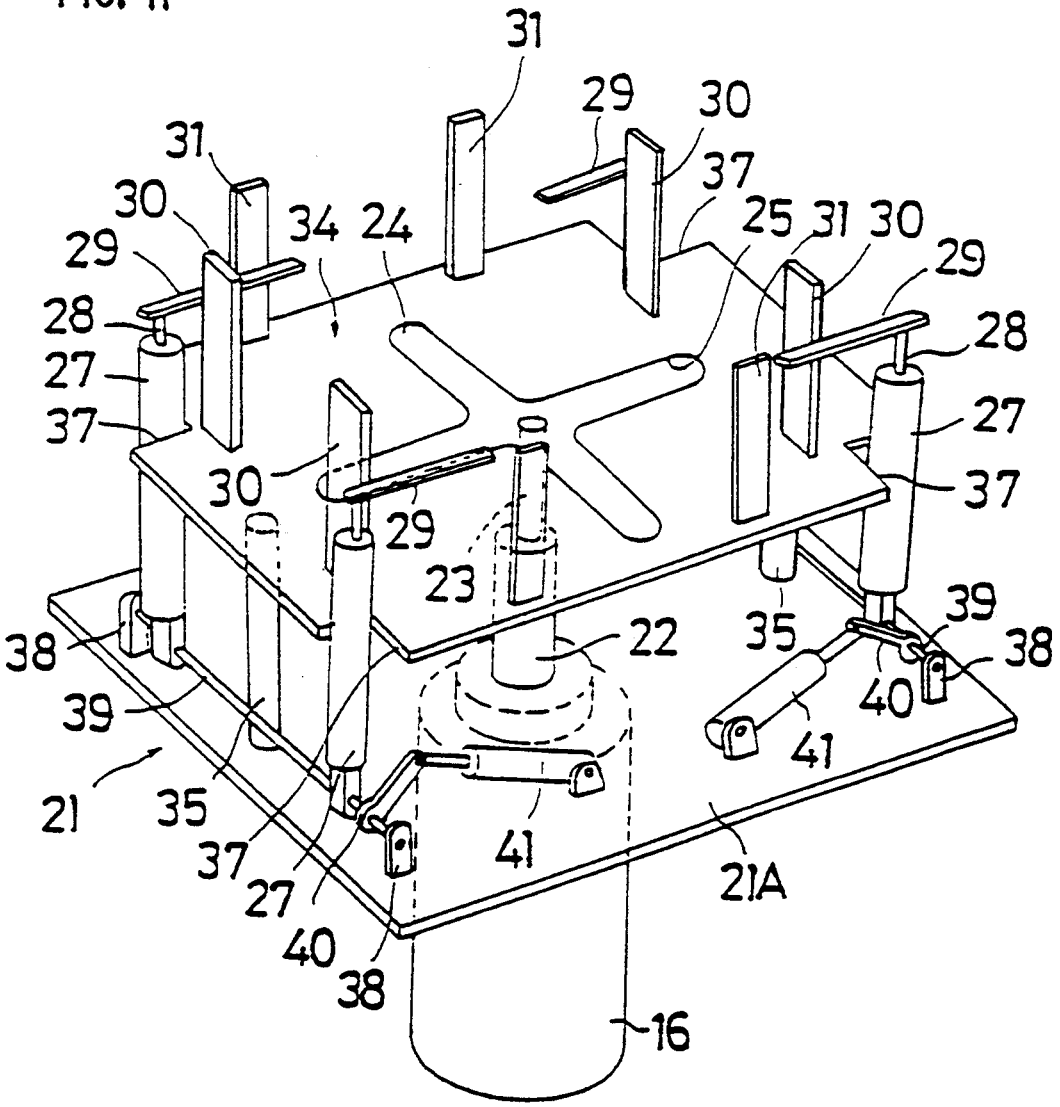
FIG. 11 is an enlarged perspective view of a stacker.

FIG. 9 shows another lift member 24 embodying the invention. The lift member 24 is not limited specifically in shape insofar as it is capable of stacking signatures of various sizes such as B4, A4 and B5 sizes.

FIGS. 10 to 14 show a second embodiment of the invention, which differs from the first embodiment in that a signature pressing member 32 which is movable upward and downward by an air cylinder 33 is provided suspended above the first stacker 1, and that the third stacker 21 has a stacking table 34 formed with an aperture 25 for the lift member 24 to pass therethrough and supported on posts 35 extending upright from a mount plate 21A. The air cylinder 33 has a downwardly projecting piston rod 36, and the signature pressing member 32, which is horizontal, is secured to the lower end of the rod. The pressing member 32 can be lowered to a position close to the receiving plate 6 without interfering with the holding belt 4. When the receiving plate 6 is retracted, the pressing member 32 pushes down the small stack of signatures 2 on the receiving plate 6 in pressing contact with the stack from above. The pressing member 32 is thereafter raised and returned to a stand-by position.

Figure 12:
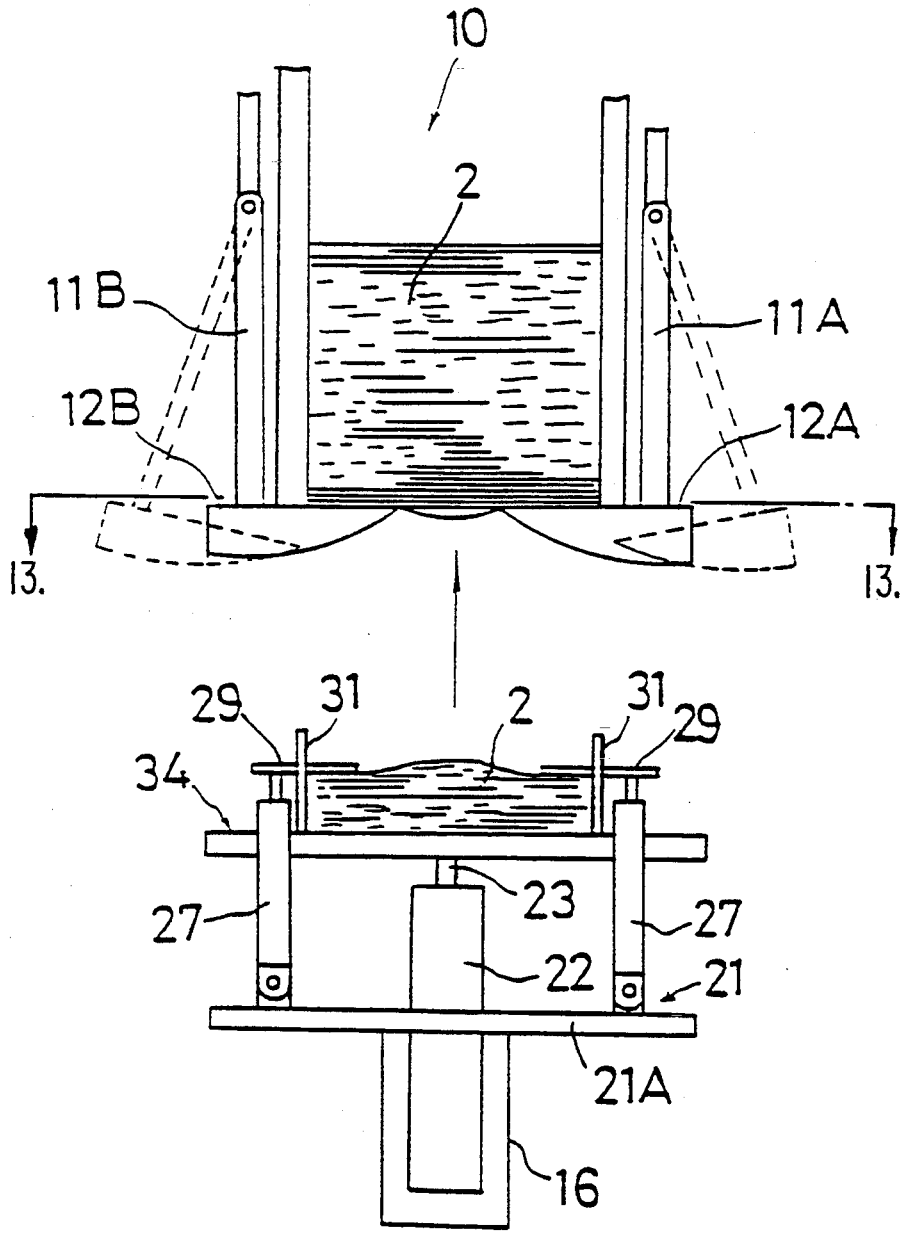
FIG. 12 is an operation illustrating side elevation showing signatures which are ready for stacking.
Figure 13:
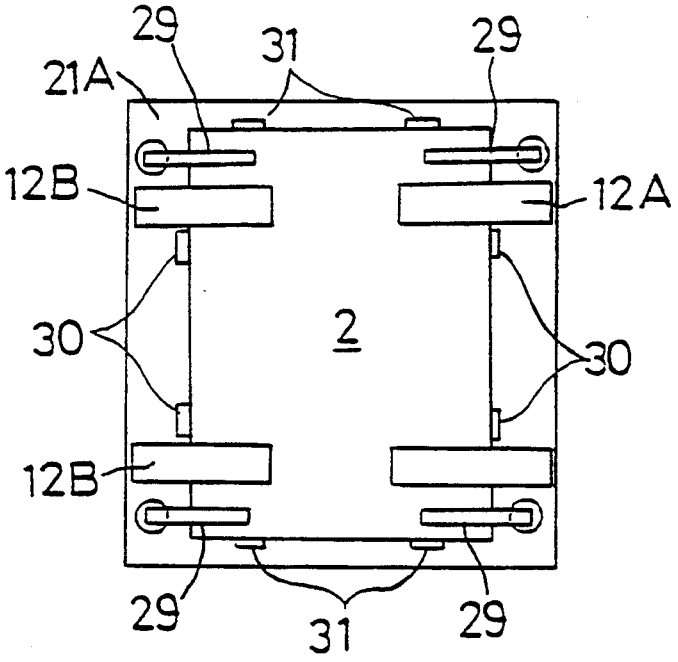
FIG. 13 is a view in section taken along the line XIII—XIII in FIG. 12.

The stacking table 34 has a cutout 37 in each of its four corners. The air cylinder 27 is positioned in the cutout 37. The cylinders 27 are mounted on the mount plate 21A by brackets 38 and a horizontal rod 39 and are pivotally movable for opening or closing. A lever 40 secured to the horizontal rod 39 is driven by an air cylinder 41 pivotally movably supported on the mount plate 21A. The pressing pieces 29 operate in the same manner as in the first embodiment. When the small stack of signatures 2 is raised to the second stacker 10, the pressing pieces 29 rise with the lift member 24 while pressing the signatures 2 as seen in FIG. 12. During the ascent, the small stack of signatures 2 approaches a large stack of signatures 2A thereabove (with the pressing pieces in an upper limit position), whereupon the lift member temporarily stops (see FIG. 14). The pressing pieces 29 are turned outward to an opened position first by the operation of the air cylinders 41 to relieve the signatures 2 of the pressure. Subsequently or simultaneously with this, the support pieces 12A, 12B retract to the broken-line position shown in FIG. 14 to open the second stacker 10. The air cylinder 22 then operates again to raise the lift member 24, which comes to a stop at its upper limit position. At the same time, the support pieces 12A, 12B advance inward toward each other to close the second stacker 10 for the stacker 10 to completely hold the resulting stack. The air cylinder 22 therefore operates to lower the lift member 24. With a small stack of signatures 2 thereafter placed onto the stacking table 34 of the third stacker 21 immediately below the first stacker 1, the third stackers 21 are revolved through 180 degrees again to repeat the above procedure. Since the pressing pieces 29 come to a halt at their upper limit position of specified level (with the small stack of signatures 2 approaching the large stack of signatures 2 and coming into contact with the support pieces 12A, 12B), the support pieces 12A, 12B are opened at this time. This eliminates the need for the cumbersome procedure of adjusting the opening and closing timing of the support pieces 12A, 12B in view of the conditions such as the height of small stack of signatures 2, paper quality and whether the signatures are those folded in two, as conventionally practiced every time signatures of different type are to be handled. The signatures can therefore be handled with greater ease and a higher efficiency in neat stacks with the bulky folds pressed while being prevented from slippage or misregister or protected from damage.

Figure 16:
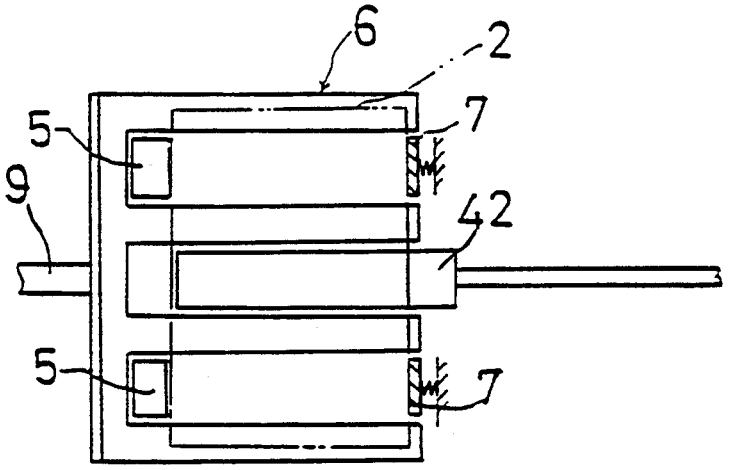
FIG. 16 is a-view in section taken along the line XVI—XVI in FIG, 15.
Figure 14:
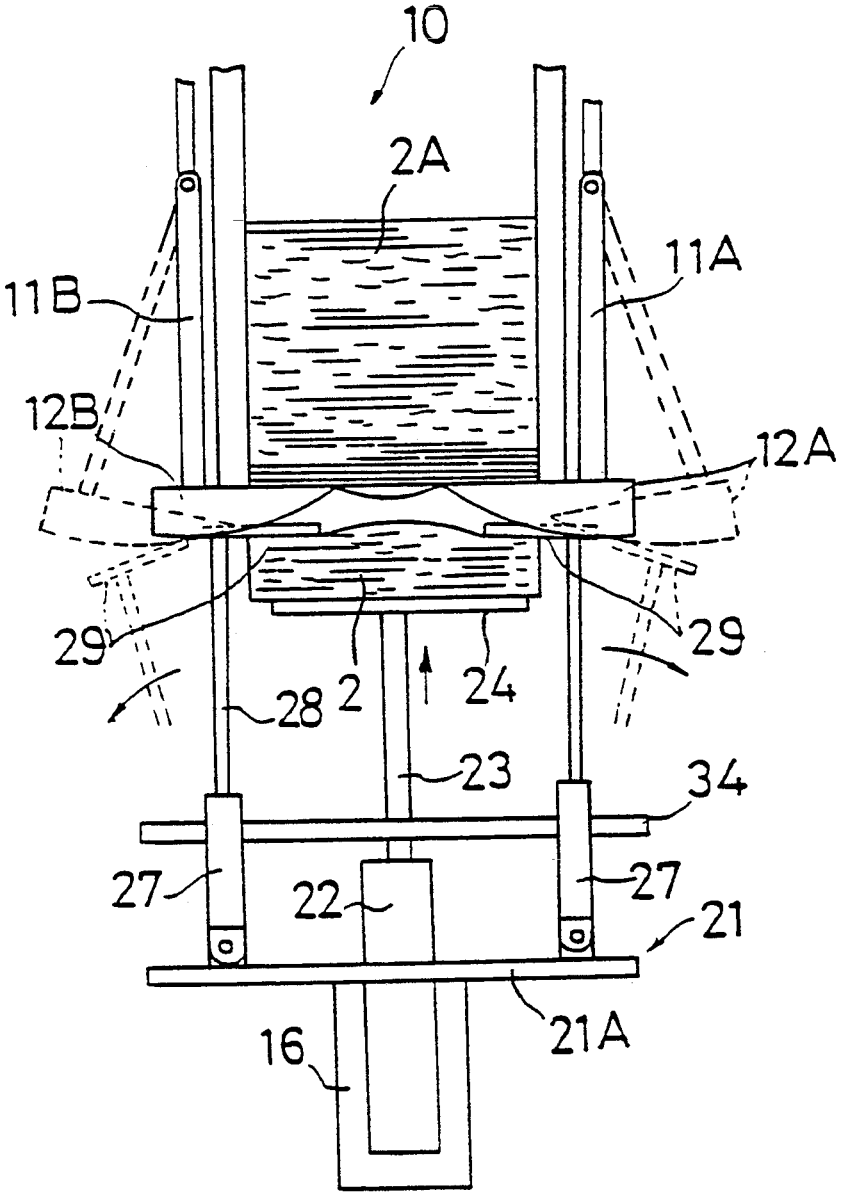
FIG. 14 is an operation illustrating side elevation showing the signatures being stacked.
Figure 15:
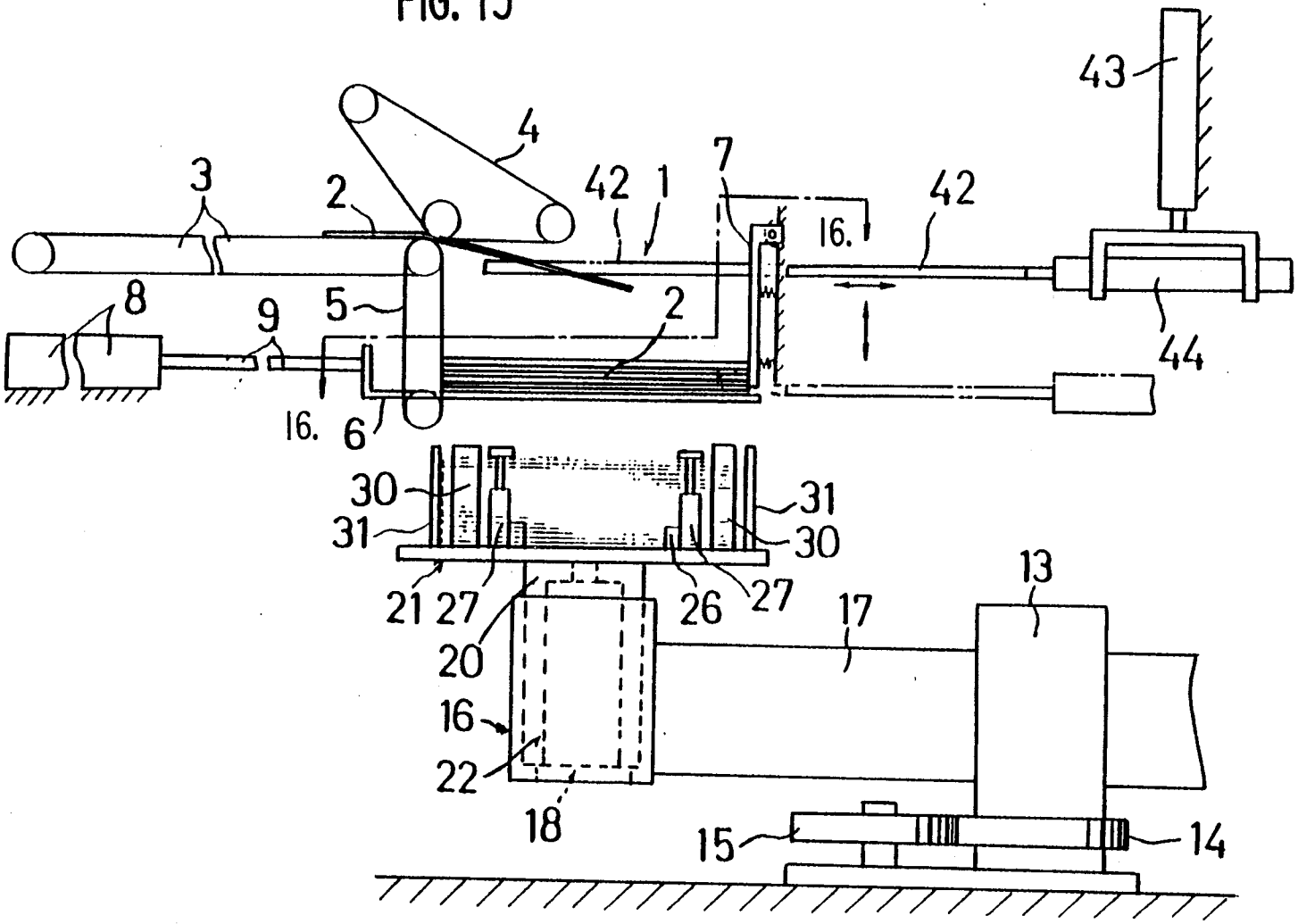
FIG. 15 is a sectional side elevation schematically showing a third embodiment of the invention.

FIGS. 15 and 16 show the main feature of a third embodiment of the invention, which differs from the first embodiment in that a signature pressing member 42 provided for the first stacker 1 is supported in suspension by a vertical air cylinder 43 and a horizontal air cylinder 44 which are arranged at one side of the stacker. The pressing member 42 is disposed in a stand-by position above the side portion of the first stacker 1. When signatures 2 are stacked on the receiving plate 6, the pressing member is advanced into the first stacker 1 by the operation of the horizontal air cylinder 44 and lowered by the vertical air cylinder 43 along with the lift member 24 while pressing the small stack of signatures 2 from above. At a lower limit position, the pressing member is retracted outward from above the third stacker 21 by the horizontal air cylinder 44 and then raised to the stand-by position by the vertical air cylinder 43. Accordingly, the third embodiment is adapted to deliver signatures 2 from the receiving plate 6 to the third stacker 21 therebelow without slipping out of place or misregistering of sheets.

The signature pressing member 42 of the third embodiment can be provided in place of the signature pressing member 32 of the second embodiment.

INDUSTRIAL APPLICABILITY

The invention is useful for apparatus for handling signatures transported from a printing press or the like to pile the signatures into small stacks and further pile such small stacks into large stacks.

We claim:

1. A signature handling apparatus which comprises:

a first stacker for accumulating small stacks of signatures;

a second stacker for piling a plurality of the small stacks of signatures accumulated by the first stacker, and a pair of third stackers arranged below the first stacker and below the second stacker respectively, the pair of third stackers being reciprocatingly revolvable beneath the first and second stackers, and a transfer mechanism for transferring the small stacks of signatures on the first stacker to one of the third stackers when said one of the third stackers is beneath the first stacker and for transferring signatures as stacked on the other third stacker to the second stacker when the other third stacker is located beneath the second stacker wherein the transferring mechanism comprises a support member rotatable about a vertical axis and a first and second rotary member mounted on the support member, the first and second rotary members each have a cylinder movable upward and downward and each includes a lift member, the third stacker has a base member with an aperture formed therein through which the lift member upwardly passes, and wherein each of the third stackers is provided with pressing pieces which are upwardly movable with the lift member while pressing a stack of signatures from above.

2. A signature handling apparatus as defined in claim 1 wherein the first stacker has a receiving plate horizontally movable for opening or closing a bottom side thereof.

3. A signature handling apparatus as defined in claim 1 wherein the transfer mechanism comprises a revolving shaft which is rotatable about a vertical axis and a support member which projects from each of diametrically opposite sides of the revolving shaft and wherein the pair of third stackers are mounted on said support member.

4. A signature handling apparatus as defined in claim 1 wherein each of the pressing pieces is attached to an extendable cylinder rotatably mounted on the third stacker.

5. A signature handling apparatus as defined in claim 1 wherein the first stacker is provided with a signature pressing member for lowering the small stack of signatures onto one of the third stackers positioned immediately below the first stacker while pressing the stack from above.

* * * * *